United States Patent [19]

Takagi et al.

[11] 4,129,769

[45] Dec. 12, 1978

[54] TIMER ARRANGEMENT IN A COMBINATION MICROWAVE OVEN AND ELECTRIC HEATING OVEN

[75] Inventors: Yutaka Takagi, Sakai; Munemitsu Toyoda, Osaka, both of Japan

[73] Assignee: Sharp Kabushiki Kaisha, Osaka, Japan

[21] Appl. No.: 776,663

[22] Filed: Mar. 11, 1977

[30] Foreign Application Priority Data

| | | | |
|---|---|---|---|
| Mar. 11, 1976 | [JP] | Japan | 51/26704 |
| Mar. 12, 1976 | [JP] | Japan | 51/27387 |
| Mar. 15, 1976 | [JP] | Japan | 51/28293 |
| Mar. 19, 1976 | [JP] | Japan | 51/33508[U] |

[51] Int. Cl.[2] ..... H05B 9/06

[52] U.S. Cl. ..... 219/10.55 B; 200/38 FA

[58] Field of Search ..... 219/10.55 BA, 10.55 R; 307/144.8; 200/38 FA, 38 A; 58/21.14, 39.5

[56] References Cited

U.S. PATENT DOCUMENTS

| | | | |
|---|---|---|---|
| Re. 28,888 | 6/1976 | Mori | 219/10.55 B |
| 3,339,054 | 8/1967 | Deaton | 219/10.55 B |
| 3,569,656 | 3/1971 | White | 219/10.55 B |
| 3,824,365 | 6/1974 | Tapper | 219/10.55 B |
| 4,025,804 | 5/1977 | Rickard | 219/10.55 B |
| 4,028,517 | 6/1977 | Tanaka et al. | 219/10.55 B |

*Primary Examiner*—J. V. Truhe
*Assistant Examiner*—Bernard Roskoski
*Attorney, Agent, or Firm*—Brich, Stewart, Kolasch & Birch

[57] ABSTRACT

A combination microwave oven and electric heating oven comprises a selection lever for selectively performing microwave heating cooking and electric heating cooking. A switching means is associated with the selection lever so as to intermittently energize a timer motor during an electric heating cooking mode, whereby a timer arrangement associated with the timer motor functions as a short interval timer when the combination microwave oven and electric heating oven is placed in a microwave heating cooking mode and the timer arrangement functions as a long interval timer when the combination microwave oven and electric heating oven is placed in the electric heating cooking mode.

10 Claims, 12 Drawing Figures

TIMER ARRANGEMENT IN A COMBINATION MICROWAVE OVEN AND ELECTRIC HEATING OVEN

BACKGROUND AND SUMMARY OF THE INVENTION

The present invention relates to a microwave oven which further functions as an electric heating oven through the use of a heater means disposed within an oven cavity and, more particularly, to a timer arrangement employed within a combination microwave oven and electric heating oven.

Microwave heating cooking is usually conducted for a time period of less than 15 minutes, and electric heating cooking is usually conducted for a time period from 10 to 60 minutes. In the case when a combination microwave oven and electric heating oven is designed, a first solution would be to provide two timer motors, one for microwave heating cooking purposes and the other for electric heating cooking purposes, in order to accurately control a cooking time period. However, it is not preferable to provide two timer motors, because the system becomes large and manual operation of two timer setting knobs associated with the two timer motors becomes complicated.

Accordingly, an object of the present invention is to provide a microwave oven which further functions as an electric heating oven.

Another object of the present invention is to provide a timer arrangement which functions as a long interval timer and a short interval timer through the use of one timer motor.

Still another object of the present invention is to provide an indication means having two different time period scales associated with a long interval timer and a short interval timer, respectively.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a selection lever is provided for selectively performing microwave heating cooking and electric heating cooking in a combination microwave oven and electric heating oven.

A switching means is associated with the selection lever so as to intermittently energize a timer motor during an electric heating cooking mode, whereby a timer arrangement associated with the timer motor functions as a long interval timer when the combination microwave oven and electric heating oven is placed in the electric heating cooking mode and the timer arrangement functions as a short interval timer when the combination microwave oven and electric heating oven is placed in a microwave heating cooking mode.

In a preferred form the switching means includes a cam mechanism driven by a turntable motor. The cam mechanism functions to intermittently energize the timer motor in the electric heating cooking mode, whereby the 15 minute timer is provided in the microwave heating cooking mode and the 60 minute timer is provided in the electric heating cooking mode through the use of one timer motor.

A timer drum having two surfaces, one including a timer scale for the 60 minute timer and the other including a timer scale for the 15 minute timer, is associated with the selection lever in such a manner that the 60 minute timer scale can be seen by the operator when the selection lever is positioned at the electric heating cooking mode, and the 15 minute timer scale can be seen by the operator when the selection lever is positioned at the microwave heating cooking mode.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
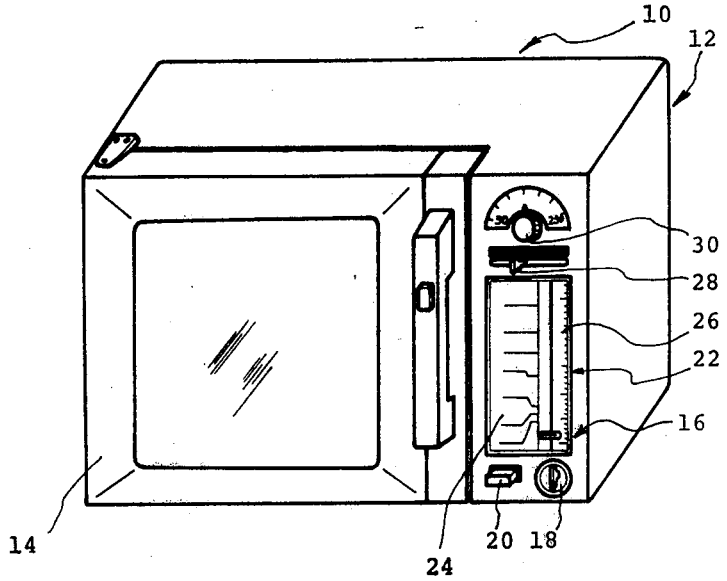
FIG. 1 is a perspective view of a combination microwave oven and electric heating oven employing an embodiment of a timer arrangement of the present invention.

FIG. 1 shows a combination microwave oven and electric heating oven employing an embodiment of a timer arrangement of the present invention. The combination microwave oven and electric heating oven 10 includes a casing 12, an oven door 14, and a control panel 16. The control panel 16 includes a timer setting knob 18, a cook switch 20, an indication panel 22 including a menu drum 24 and a timer scale 26, a selection lever 28, and a temperature setting knob 30.

Figure 2:
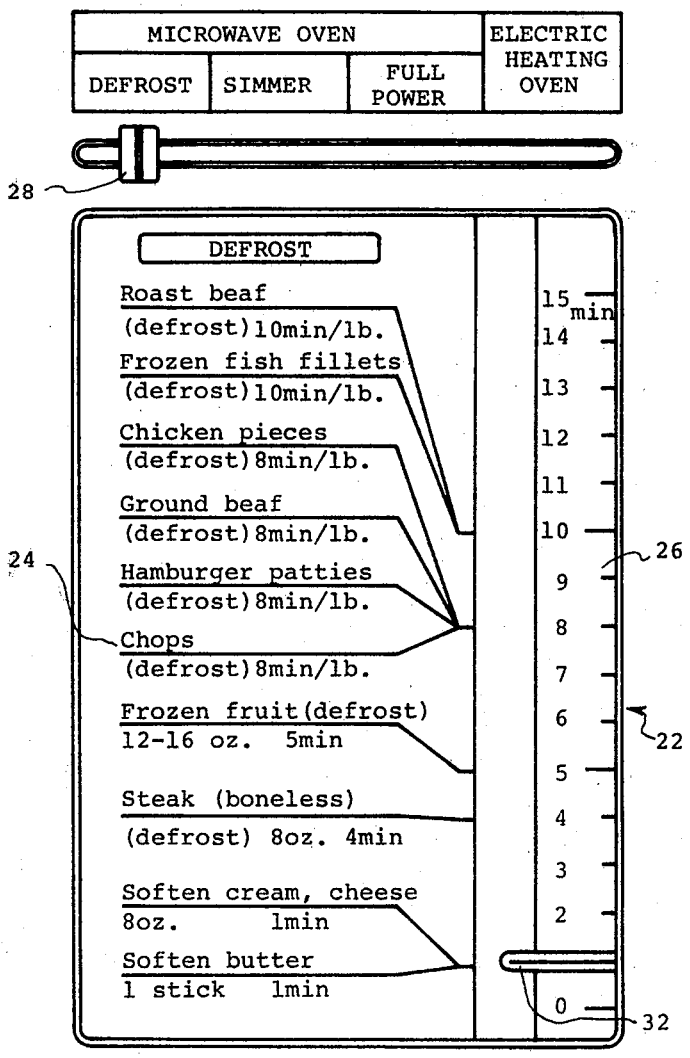
FIG. 2 is a front view of an indication panel of the combination microwave oven and electric heating oven of FIG. 1.

FIG. 2 shows a detailed construction of the indication panel 22. The selection lever 28 is used to select operation modes of the combination microwave oven and electric heating oven 10. That is, the combination microwave oven and electric heating oven 10 functions as an electric heating oven or a microwave oven in accordance with the location of the selection lever 28. The combination microwave oven and electric heating oven 10 provides three different effective average microwave powers, namely, the combination microwave oven and electric heating oven 10 operates in a defrost mode, a simmer mode, or a full power mode. A typical construction for varying the effective average microwave power is shown in Carl L. Anderson, U.S. Pat. No. 3,995,133, "VARIABLE POWER CONTROL FOR MICROWAVE OVEN" and, therefore, a detailed construction of the varying means is omitted from the description for the purpose of simplicity.

FIG. 2 shows a condition when the combination microwave oven and electric heating oven is placed in the defrost mode. The menu drum 24 shows menus suited for the defrost mode cooking, and the timer scale 26 shows that a timer arrangement functions as a 15 minute interval timer. A cooking period is set through the use of the timer setting knob 18, and the time period being set is indicated by a needle 32.

When the combination microwave oven and electric heating oven 10 is placed in the electric heating mode, the menu drum 24 shows menus suited for the electric heating mode cooking, and the timer arrangement functions as a 60 minute interval timer. The timer scale 26 shows the 60 minute scale. A mechanism for varying the indication of the menu drum 24 and the timer scale 26 will be described later. The temperature setting knob 30 is used to set an oven temperature at a desired value when the combination microwave oven and electric heating oven operates in the electric heating mode.

FIGS. 3A and 3B illustrated a mechanism for rotating the menu drum 24 and the timer scale 26 in accordance with the location of the selection lever 28.

The selection lever 28 is fixed to a movable plate 34, which is supported rotatably around a pin 36 secured by a stationary plate 38. A guide opening 40 is formed in the movable plate 34, which engages a pin 42 fixed to the stationary plate 38, whereby the shift operation of the selection lever 28 is guided. The movable plate 34 includes a geared plate 44 to which a gear 46 is associated. The gear 46 is fixed to a shaft 48 rotatably secured to the stationary plate 38. The menu drum 24 is supported by the shaft 48, whereby the menu drum 24 is rotated through the use of selection lever 28 via the gear plate 44 and the gear 46.

A pin 50 is fixed to the movable plate 34, whereby the timer scale 26 is rotated in accordance with the location of the selection lever 28. When the selection lever 28 is shifted to the location related to the electric heating cooking mode, namely, the rightmost position, as shown in FIG. 3B of the drawings, the pin 50 engages an indent 52 formed in a timer scale drum 54 (corresponding to the timer scale 26), thereby rotating the timer scale drum 54 so that the 60 minute timer scale appears at the indication panel 22. When the selection lever 28 is shifted leftward, as shown in FIG. 3A, from the location related to the electric heating cooking mode, the timer scale drum 54 is rotated counterclockwise as seen at FIG. 4 so that the 15 minute timer scale appears at the indication panel 22.

Figure 5:
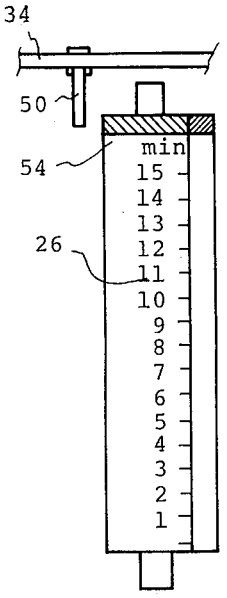
FIG. 5 is a front view of the surface of the timer drum including a 15 minute timer scale.
Figure 6:
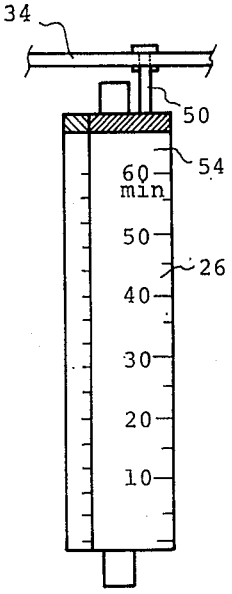
FIG. 6 is a front view of another surface of the timer drum including a 60 minute timer scale.

FIG. 5 shows a condition when the selection lever 28 is located at the microwave heating cooking mode and the 15 minute scale appears at the indicaiton panel. FIG. 6 shows a condition when the selection lever 28 is located at the electric heating cooking mode and the 60 minute scale appears at the indication panel.

Referring again to FIG. 3B, when the selection lever 28 is positioned at the electric heating cooking mode, two microswitches 56 and 58 are closed, whereby the combination microwave oven and electric heating oven is placed in the electric heating cooking mode, and the timer arrangement functions as a 60 minute interval timer. A wire means 60 is connected to the movable plate 34, thereby changing the color illuminating the oven cavity. The mechanism for changing the illumination color will be described later with reference to FIG. 10.

Figure 7:
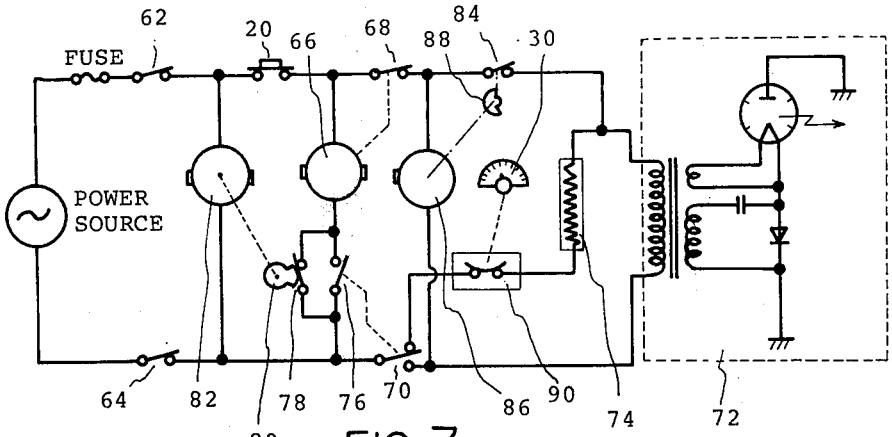
FIG. 7 is a circuit diagram of an embodiment of a control circuit employed within the combination microwave oven and electric heating oven of FIG. 1.

FIG. 7 shows a control circuit of the combination microwave oven and electric heating oven of FIG. 1.

Interlock switches 62 and 64 are associated with the opening and closing of the oven door 14. A timer motor 66 is associated with the timer setting knob 18 and functions to close a timer contact 68 during a time period determined by the timer arrangement associated with the timer setting knob 18. A first switching means 70 is associated with the microswitch 56 so as to energize a microwave generator 72 when the selection lever 28 is positioned at any one of the defrost mode, simmer mode and the full power mode, at which movement the microswitch 56 is open, and to enegize a heater means 74 for electric heating cooking purposes when the selection lever 28 is positioned at the electric heating mode and the microswitch 56 is closed.

A second switching means 76 is associated with the microswitch 58 in such a manner that the second switching means 76 is closed when the microswitch 58 is open and the second switching means 76 is open when the microswitch 58 is closed. That is, the timer motor 66 is continuously enabled when the combination microwave oven and electric heating oven is placed in the microwave heating cooking mode, whereby the timer arrangement functions as the 15 minute timer. When the combination microwave oven and electric heating oven is placed in the electric heating cooking mode, the second switching means 76 is open and, therefore, the timer motor 66 is enabled only when a third switching means 78 is closed.

A cam mechanism 80 is associated with the third switching means 78 and is driven to rotate by a turntable motor 82. That is, the third switching means 78 is closed by the cam mechanism 80 for one fourth the period of one revolution of the turntable motor 82. In this way, the timer arrangement functions as the 60 minute timer when the combination microwave oven and electric heating oven is placed in the electric heating cooking mode.

A fourth switching means 84 is associated with a variable cooking mode selector including a motor 86 and a cam mechanism 88. A detailed construction of the variable cooking mode selector is shown in the already discussed U.S. Pat. No. 3,995,133. The microwave generator 72 is continuously energized in the full power mode and is intermittently energized in the simmer mode and the defrost mode.

The fourth switching means 84 is continuously closed in the electric heating cooking mode. Power supply to the heater means 74 is controlled by a temperature control system 90 associated with the temperature setting knob 30.

Figure 8:
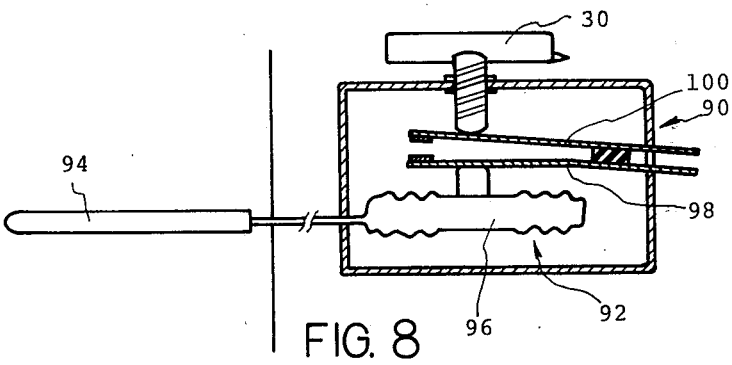
FIG. 8 is a sectional view of a temperature control system employed within the combination microwave oven and electric heating oven of FIG. 1.

FIG. 8 shows the temperature control system 90. The temperature control system 90 mainly comprises a liquid expansion thermostat 92 connected to a temperature sensor 94 disposed within the oven cavity so as to maintain the interior of the oven cavity at a desired temperature selected by the temperature setting knob 30. The liquid expansion thermostat 92 comprises a section 96 of which volume varies in a fashion depending on the temperature detected by the temperature sensor 94, a first contact plate 98 associated with the section 96, and a second contact plate 100 associated with the temperature setting knob 30. The first and second contact plates 98 and 100 are associated with each other in such a manner as to energize the heater means 74 when the two contact plates 98 and 100 are separated from each other.

Figure 9:
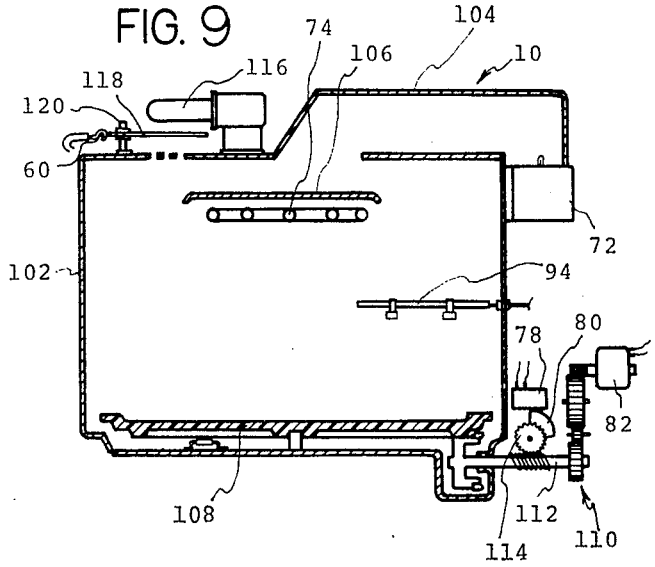
FIG. 9 is a sectional view of the combination microwave oven and electric heating oven of FIG. 1.

FIG. 9 shows the interior of the combination microwave oven and electric heating oven 10. Like elements corresponding to those of FIGS. 1 through 8 are indicated by like numerals.

The oven cavity is surrounded by an oven wall 102 made of metal. The microwave generator 72 is secured on the oven wall 102 and is connected to the oven cavity via a waveguide 104. The heater means 74 is disposed at the upper portion within the oven cavity, and is covered by a reflection plate 106. A turntable 108 is secured at the bottom of the oven cavity, and is driven to rotate by the turntable motor 82 via a speed reduction means 110 and a driving shaft 112. A gear 114 is associated with the driving shaft 112, and the cam mechanism 80 is fixed to the gear 114 in such a manner as to rotate in unison with the gear 114. It will be clear from FIG. 9 that the third switching means 78 is closed for a one fourth period of one revolution of the gear 114.

Figure 10:
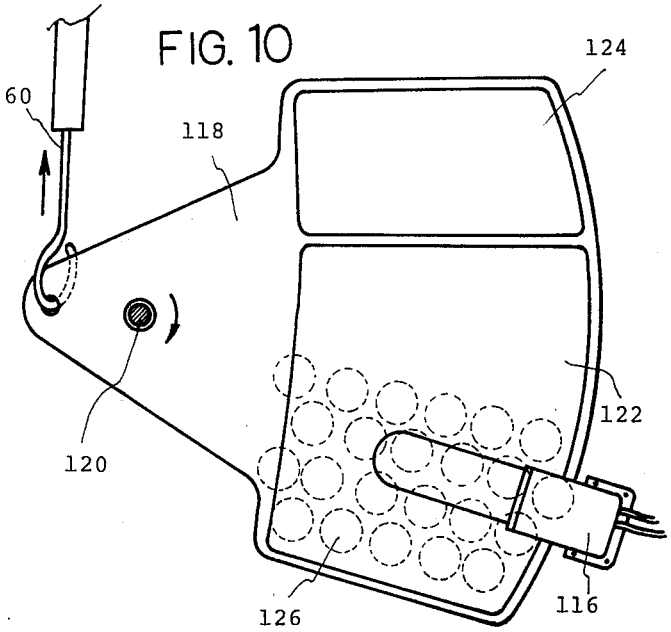
FIG. 10 is a plan view of an illumination means employed within the combinaiton microwave oven and electric heating oven of FIG. 1.

An illumination lamp 116 is provided for illuminating the interior of the oven cavity. A filter plate 118 is associated with the wire means 60 in such a manner as to change the illuminating light color. FIG. 10 shows the mechanism for changing the illuminating light color. Like elements corresponding to those of FIG. 9 are indicated by like numerals.

The filter plate 118 is secured rotatably around a shaft 120 fixed to the oven wall 102. The filter plate 118 is rotated around the shaft 120 in response to the location of the selection lever 28 through the movable plate 34 and the wire means 60. The filter plate 118 includes a blue colored filter portion 122 and a red colored filter portion 124, whereby the interior of the oven cavity is illuminated by the blue colored light, through openings 126 formed in the upper wall of the oven cavity, during the microwave heating cooking, and the interior of the oven cavity is illuminated by the red colored light during the electric heating cooking.

Figure 3:
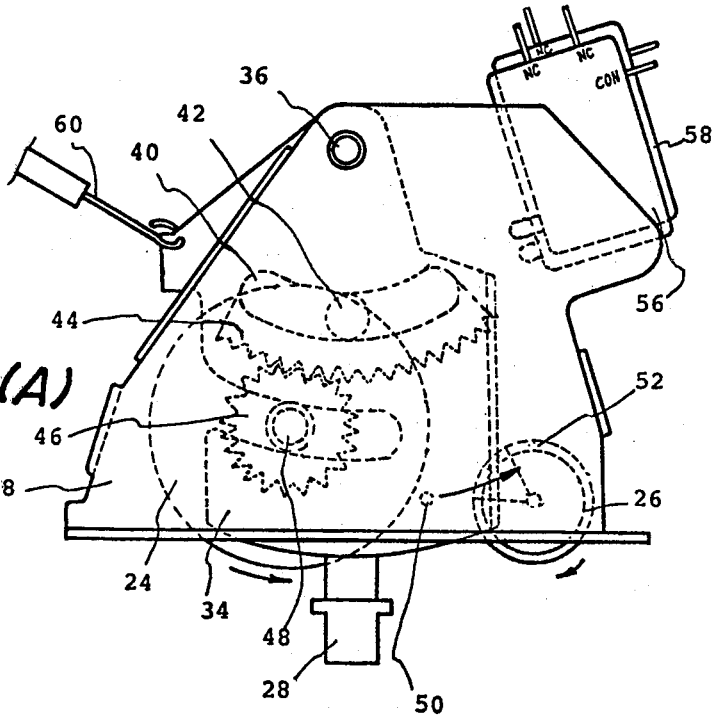
FIGS. 3A and 3B are plan views of an embodiment of a selection mechanism of the timer arrangement of the present invention.
Figure 3:
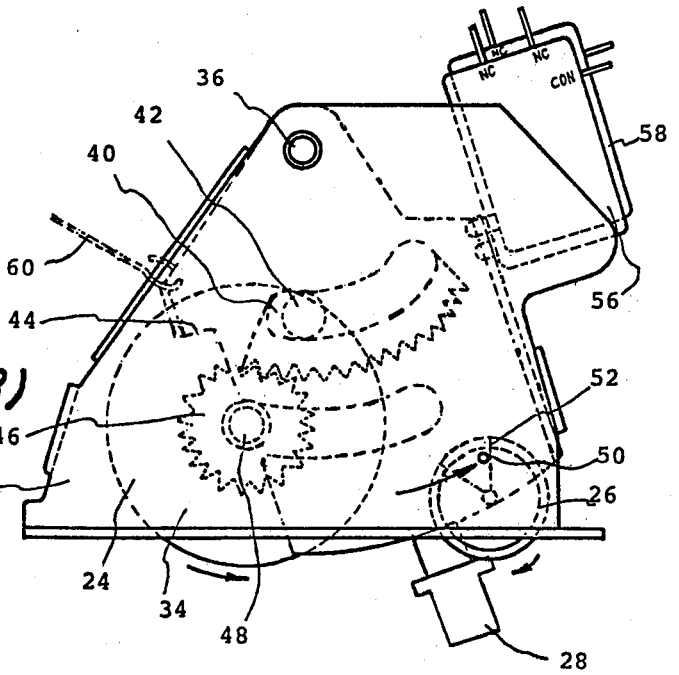
Figure 4:
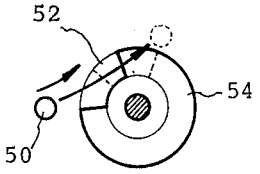
FIG. 4 is a plan view of a timer drum employed within the selection mechanism of FIG. 3.
Figure 11:
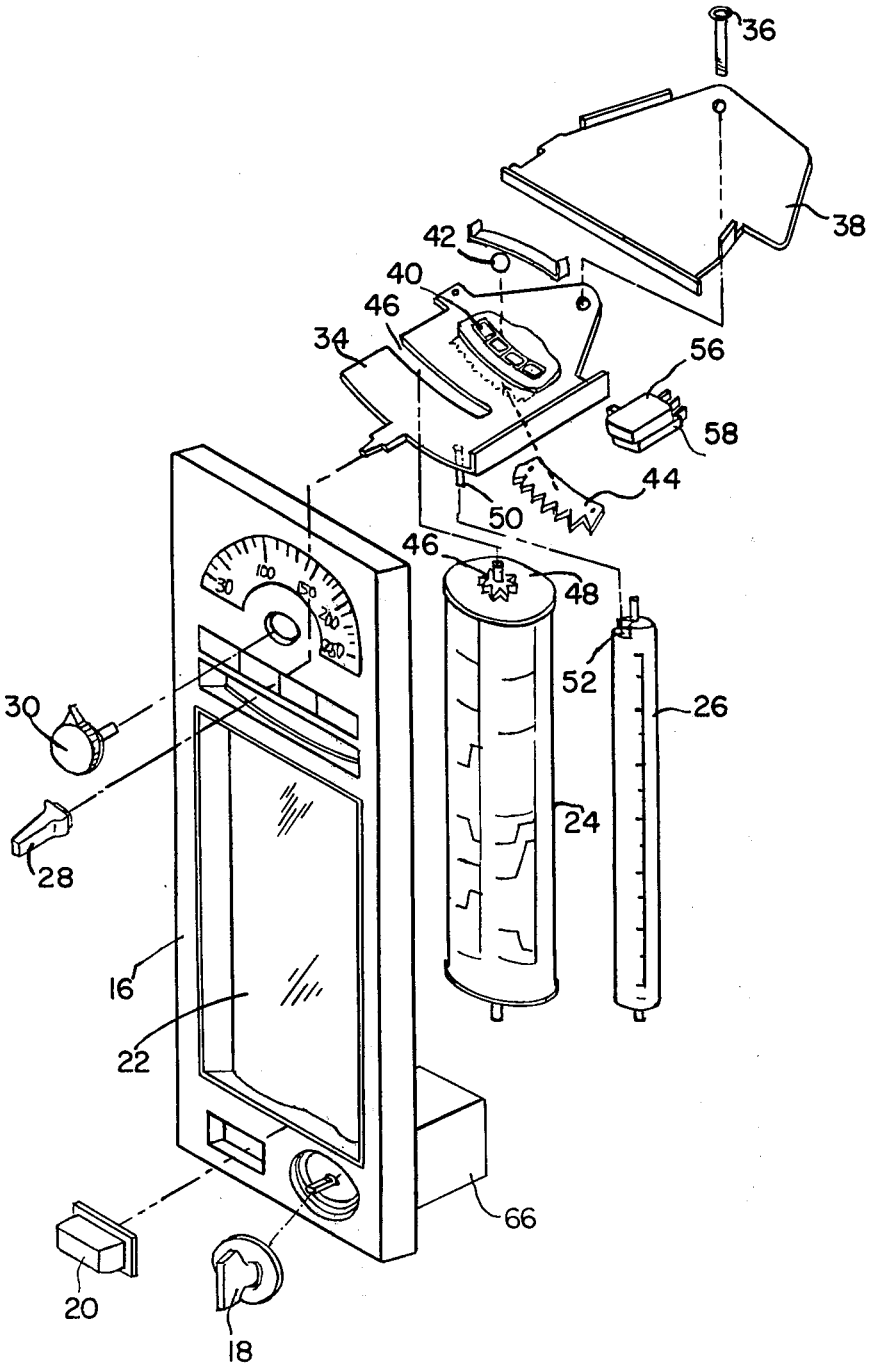
FIG. 11 is an exploded view of the selection mechanism of the timer arrangement of FIGS. 3A and 3B.

FIG. 11 illustrates an exploded view of the selection mechanism of the timer arrangement shown in FIGS. 3A and 3B. Like elements corresponding to those illustrated in FIGS. 1–7 are indicated by like numerals.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combination microwave oven and electric heating oven comprising:

a. an oven compartment;

b. a microwave generator for performing microwave heating cooking;

c. a heater means disposed within said oven compartment for performing electric heating cooking;

d. a selection means for selectively energizing the microwave generator and the heater means;

e. a timer arrangement including a timer setting means for setting a desired cooking period, and a timer motor associated with the timer setting means; and f. switching means associated with said selection means for continuously enabling said timer motor when the combination microwave oven and electric heating oven is placed in a microwave heating cooking mode, and for intermittently enabling said timer motor when the combination microwave oven and electric heating oven is placed in an electric heating cooking mode, whereby said timer arrangement functions as a short interval timer in the microwave heating cooking mode and as a long interval timer in the electric heating cooking mode.

2. The combination microwave oven and electric heating oven of claim 1, wherein said switching means comprises:

$f_1$. a first switch connected to said timer motor in a series fashion;

$f_2$. a second switch connected to said first switch in a parallel fashion;

$f_3$. actuating means for intermittently closing said second switch; and $f_4$. means associated with said selection means for closing said first switch when the combination microwave oven and electric heating oven is placed in the microwave heating cooking mode, and for opening said first switch when the combination microwave oven and electric heating oven is placed in the electric heating cooking mode.

3. The combination microwave oven and electric heating oven of claim 1, wherein said timer arrangement functions as a 60 minute interval timer in the electric heating cooking mode, and functions as a 15 minute interval timer in the microwave heating cooking mode.

4. The combination microwave oven and electric heating oven of claim 1, which further comprises:

g. an indication means including a short interval timer scale and a long interval timer scale; and h. shifting means associated with said selection means for enabling said short interval timer scale in the microwave heating cooking mode, and for enabling said long interval timer scale in the electric heating cooking mode.

5. The combination microwave oven and electric heating oven of claim 4, wherein said indication means comprises a timer scale drum having two surfaces, one including the short interval timer scale and the other including the long interval timer scale, and the shifting means functions to rotate said timer scale drum in response to said selection means.

6. A combination microwave oven and electric heating oven comrpising:

an oven compartment;

a microwave generator for performing a microwave heating mode;

a heater means disposed within the oven compartment for performing an electric heating mode;

a timer;

an indication means for displaying time passage using the timer:

a mode selector for selecting a mode between the microwave heating mode and the electric heating mode; and means for changing the rate of movement of the indication means in response to the actuation of the mode selector.

7. The combination microwave oven and electric heating oven of claim 6, wherein the means for changing the rate of movement of the indication means comprises switching elements for moving the indication means to a first position thereof in the microwave heating mode and for moving the indication means to a second position thereof in the electric heating mode.

8. The combination microwave oven and electric heating oven of claim 7, wherein the timer is continuously energized when the indication means is in the first position and the timer is intermittently energized when the indication means is in the second position.

9. The combination microwave oven and electric heating oven of claim 7, wherein the energization of the timer in the second position of the indicator means is one-fourth of the energization of the timer in the first position of the indication means.

10. A combination microwave oven and electric heating oven comprising:

an oven compartment;

a microwave generator for performing microwave heating mode;

a heater means disposed within the oven compartment for performing electric heating mode;

a timer;

a first time scale means for the microwave heating mode and a second time scale means for the electric heating mode, wherein said first time scale is exposed only during the microwave heating mode and said second time scale is exposed only during the electric heating mode;

a mode selector for selecting a mode between the microwave heating mode and the electric heating mode;

an indication means for displaying time passage using the timer; and means for selecting one of the two time scale means to be exposed in response to the actuation of the mode selector.

* * * * *